US006311630B1

(12) United States Patent
Vanhatalo

(10) Patent No.: US 6,311,630 B1
(45) Date of Patent: Nov. 6, 2001

(54) METHOD AND DEVICE FOR REMOVAL OF SODA MELT FROM A SODA RECOVERY UNIT

(75) Inventor: Timo Juhani Vanhatalo, Imatra (FI)

(73) Assignee: Kaakon Teollisuuspalvelu Oy, Imatra (FI)

( * ) Notice: Subject to any disclaimer, the term of this patent is extended or adjusted under 35 U.S.C. 154(b) by 0 days.

(21) Appl. No.: 09/554,335

(22) PCT Filed: Nov. 12, 1998

(86) PCT No.: PCT/FI98/00883

§ 371 Date: Sep. 13, 2000

§ 102(e) Date: Sep. 13, 2000

(87) PCT Pub. No.: WO99/27180

PCT Pub. Date: Jun. 3, 1999

(30) Foreign Application Priority Data

Nov. 12, 1997 (FI) ..... 974206

(51) Int. Cl.[7] ..... F23J 1/00

(52) U.S. Cl. ..... 110/342; 110/165 R; 110/165 A

(58) Field of Search ..... 222/591, 592, 222/593, 595; 266/45, 236, 271; 162/29, 30.1, 30.11, 31; 110/165 R, 165 A, 297, 301, 309, 341, 342, 348

(56) References Cited

U.S. PATENT DOCUMENTS

| | | | | |
|---|---|---|---|---|
| 1,670,156 | * | 5/1928 | Howell | 162/30.1 |
| 4,011,047 | | 3/1977 | Tremblay . | |
| 4,628,828 | * | 12/1986 | Holtham et al. | 110/165 R |
| 4,750,649 | * | 6/1988 | Fahey et al. | 222/592 |
| 5,478,440 | * | 12/1995 | Paju | 162/30.1 |
| 5,635,095 | | 6/1997 | Kleinfeld . | |
| 5,976,319 | * | 11/1999 | Paju et al. | 162/30.1 |

* cited by examiner

*Primary Examiner*—Henry Bennett
*Assistant Examiner*—K. B. Rinehart
(74) *Attorney, Agent, or Firm*—Young & Thompson

(57) ABSTRACT

Method and device for removal of soda melt from a soda recovery boiler in conjunction with shutdown of the soda recovery boiler, in which method the supply of lye into the boiler is interrupted and, if necessary, the pile of congealed soda accumulated in the boiler is burned using the flame of a gas or oil burner until the soda melt surface in the soda recovery boiler has fallen to the level of the lower edge of the discharge opening. According to the invention, the heating of the soda melt with the gas or oil burner flame is continued so as to keep it in the molten state and the soda melt is pumped out from the soda recovery boiler.

10 Claims, 1 Drawing Sheet

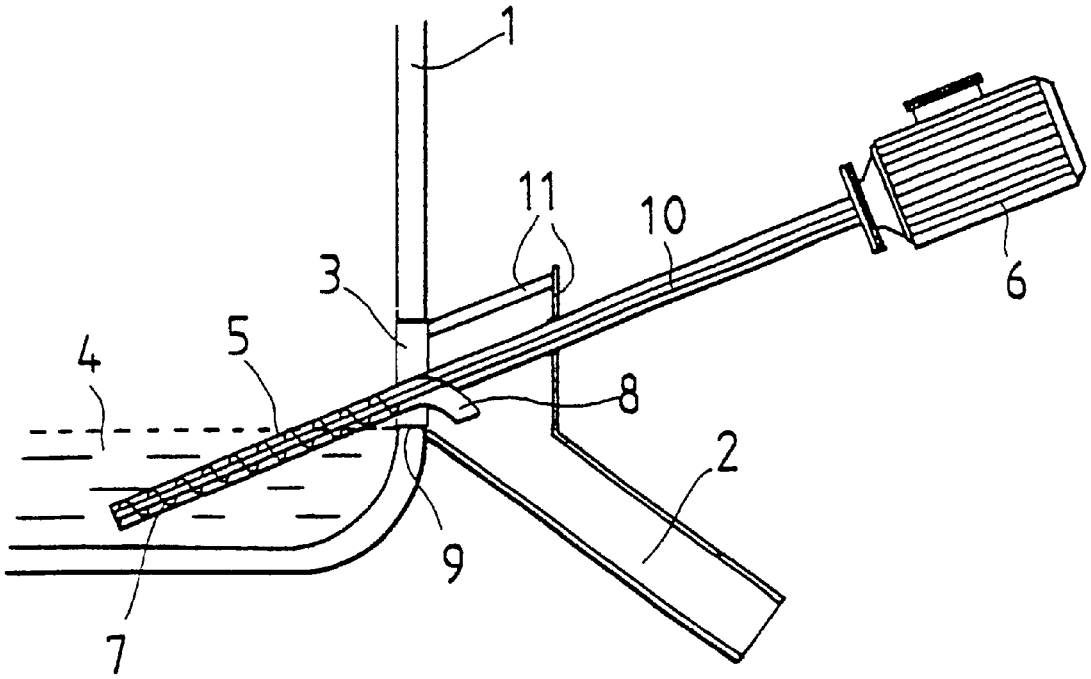
1
11
10
3
6
5
4
8
2
9
7

METHOD AND DEVICE FOR REMOVAL OF SODA MELT FROM A SODA RECOVERY UNIT

CROSS REFERENCE TO RELATED APPLICATION

This is the 35 USC 371 national stage of international application PCT/FI98/00883 filed on Nov. 12, 1998, which designated the U.S.A.

FIELD OF THE INVENTION

The present invention relates to a method and to a device for removal of soda melt from a soda recovery boiler.

BACKGROUND OF THE INVENTION

In the production of cellulose by the so-called sulphate process, wood chips are cooked in an alkaline cooking liquor in which the active components are sodium hydroxide (NaOH) and sodium sulphide ($Na_2S$). These become oxygenated in the cooking process, producing carbonates and sulphates. In addition, about 50% of the wood, above all the lignins and hemicellulose, but also the minerals in the wood are dissolved.

The black lye produced in the process is burned in a soda recovery unit, allowing its heat content to be recovered and the useful chemicals contained in it to be recycled.

In the soda recovery unit or recovery boiler, the black lye is burned and the soda lye contained in the mixture as an incombustible component, substantially consisting of sodium sulphide and sodium carbonate, melts on the bottom of the recovery boiler through the agency of hear. The temperature of the soda melt is generally between 800–1050° C. During normal use of the soda recovery boiler, the soda melt flows out of the boiler via a channel when the level of soda melt in the boiler rises above the lower edge of the discharge opening of the channel. The soda melt flows out of the recovery boiler via the soda melt channel and is broken up into tiny droplets by means of a steam jet. The soda lye thus broken up s conveyed in the form of small particles into a solution tank and dissolved in water.

The lower edge of the discharge opening in a soda recovery boiler is generally at a height of 0.4–0.6 m from the bottom of the boiler. Therefore, there is always a layer o f soda melt of corresponding thickness on the bottom of the soda recovery boiler, the purpose of which is, among other things, to ensure a uniform combustion process and to collect the waste products on the bottom of the soda recovery boiler while the soda melt is recovered from the surface of the soda melt layer.

In down-time situations, the soda melt cools down and hardens at the bottom of the soda recovery boiler. The soda melt thus congealed is removed from the boiler by crushing the mass and taking it out using spades and a wheelbarrow in confined spaces via the discharge opening and further on a truck to a dumping place. The remainder of the congealed soda melt is loosened from the bottom of the soda recovery boiler by using a high-pressure water jet and dissolving it in water. Normally, the washing water must first be gathered in safety reservoirs, from where it is slowly drained to a sewage treatment plant because a large amount of lye would destroy the purification processes of the sewage treatment plant.

The current method used for cleaning a soda recovery unit involves a difficult and slow operation and a long down-time period in the soda recovery unit. Removing the congealed soda melt in solid state from the soda recovery unit means manual efforts by several people working in difficult and confined spaces. Transporting the congealed soda melt, of which there may be as much as 100 $m^3$ at a time, to the dumping place is expensive. Treatment of the washing water is always a slow and difficult process, and if the washing water is taken to a sewage treatment plant, it will impair the purification process. Moreover, the solid mass removed and taken to a dumping place consists of relatively valuable chemicals, which are thus removed from the process and have to be replaced with new chemicals.

SUMMARY OF THE INVENTION

The object of the present invention is to eliminate the drawbacks described above. A specific object of the present invention is to disclose a new type of method and a corresponding device by means of which soda melt can be quickly and easily removed from a soda recovery unit while producing a minimal amount of waste.

As for the features characteristic of the invention, reference is made to the claims.

In the method of the invention for removal of soda melt from a soda recovery boiler, in conjunction with the shutting down of the soda recovery boiler, the supply of lye into the boiler is interrupted and, if necessary, the pile of congealed soda accumulated in the boiler is burned using the flame of a gas or oil burner so that the soda melt surface in the soda recovery boiler falls to the level of the lower edge of the discharge opening. According to the invention, the heating of the soda melt with the gas or oil burner flame is continued so as to prevent it from congealing and the soda melt is removed from the soda recovery boiler by pumping.

The soda melt is preferably pumped out from the soda recovery boiler via the soda melt discharge opening, in which case no separate pumping orifices or other structural changes need to made even in existing soda recovery units.

The pumping is preferably effected using a spiral pump with a long suction pipe that can be inserted into the soda recovery boiler and a spiral rotating inside the pipe. If a sufficiently long suction pipe is used, it can be inserted into the soda recovery boiler via the discharge opening of the soda melt channel while the motor and even all the bearings of the pump remain outside the boiler.

Since the temperature inside the soda recovery boiler is relatively high, the suction pipe and the spiral are preferably preheated before they are inserted in the soda melt. As the suction pipe and spiral may be relatively long, e.g. about 5 m, they may be distorted by the temperature variations. For this reason, the preheating is preferably performed by rotating the spiral in the suction pipe while at the same time pushing the pump into the soda recovery boiler and into the soda melt. Moreover, the spiral is rotated in the opposite direction relative to the pumping direction to ensure that no hot soda melt will splash out upon the installers under any circumstances during installation of the pump. As the soda melt is pumped out via the soda melt discharge opening, it is also natural that the soda melt should be pumped into the soda melt channel, allowing it to be treated and recycled in exactly the same way as is done during normal operation of the soda recovery unit.

The device of the invention for removal of soda melt from a soda recovery unit comprises a suction pipe designed to be inserted into the soda melt through the discharge opening of the soda melt channel, a spiral rotatable inside the suction pipe by means of a power means, and a soda melt outlet duct opening outside the soda recovery boiler. The outlet duct is preferably so disposed in the suction pipe that it opens in the soda melt channel.

The outlet duct may only consist of an orifice placed at a suitable location in the suction pipe, but preferably the outlet duct consists of a pipe or canal of e.g. branching out with a downward curvature from the suction pipe toward the soda melt channel. In this way, the soda melt can be removed from the soda recovery boiler via a relatively closed route into the soda melt channel, thus preventing it from splashing out in the surrounding spaces.

As compared with prior art, the method and device of the invention have significant advantages. The service down-time periods of soda recovery units can be reduced to a fraction of their present duration. The amount of work to be done inside the soda recovery unit in awkward and cramped working conditions can be minimised. The amount of solid and liquid waste produced in conjunction with shut-down of the soda recovery unit is minimised. Transportation of solid waste to a dumping place is avoided. The load of harmful effluents imposed on the sewage treatment plant is significantly reduced. Valuable chemicals, which so far have had to be replaced with new chemicals, are recovered.

BRIEF DESCRIPTION OF THE DRAWINGS

In the following, the invention will be described in detail by referring to the attached drawing, which presents a diagram gram illustrating the method and device of the invention.

DETAILED DESCRIPTION OF THE INVENTION

The drawing shows a diagram of a system comprising a soda recovery boiler 1 with a discharge opening 3 in its lower part, through which the soda melt 4 in the soda recovery boiler can flow out into a soda melt channel 2 in a normal operating situation. The lower edge 9 of the discharge opening 3 is at such a height in the soda recovery boiler that the thickness of the soda melt layer 4 on the bottom of the boiler is generally between 0.4–0.6 m.

When the soda melt 4 on the bottom of the soda recovery boiler 1 is to be removed as completely as possible, a device as presented in the drawing is used. The device comprises a long suction pipe 5 attached to a motor 6. Placed inside the suction pipe is a rotatable spiral 7 connected to the shaft of the motor 6. The spiral 7 extends in the shaft 10 from the end of the suction pipe 5 through a distance toward the motor 6 so that, at the upper end of the spiral, an outlet duct 8 of a curved shape branches off from the suction pipe. In conjunction with the soda melt channel 2 various supporting and shielding structures 11 can be used to support the suction pipe 5 and prevent the hot soda melt from splashing out outside the soda recovery boiler.

The apparatus presented in the drawing is used as follows. When the soda recovery unit 1 is to be shut down, the supply of lye into the boiler is stopped but the heating of the soda melt 4 is continued using the gas or oil burner of the soda recovery unit so as to keep the soda melt in the molten state. After the surface of the soda melt has fallen to the level of the lower edge 9 of the discharge opening 3, i.e. When no more soda melt is flowing out by itself from the soda recovery boiler, the suction pipe 5 is inserted through the discharge opening 3 into the soda melt 4. Simultaneously with pushing the suction pipe into the soda melt, the spiral 7 is rotated by means of the motor 6 in the direction opposite to the pumping direction so that, while the pump is being installed, no hot soda melt will be discharged by any chance via the outlet duct 8. At the same time, the rotation of the spiral 7 ensures that it will be uniformly heated in the hot soda melt and remain straight inside the suction pipe. The suction pipe is preferably inserted in the soda recovery boiler so that the tip of the suction pipe goes to the lowest point in the boiler while the outlet duct 8 is directed downward toward the soda melt channel 2. After this, the pumping can be started by operating the motor 6 so as to make the spiral 7 rotate in the pumping direction. The soda melt is now discharged via the outlet duct 8 into the soda melt channel 2, from where it can be passed further to a steam jet treatment as is known in the art, before being dissolved in water.

When this method and device are used, the result is a relatively clean soda recovery boiler with only 5–10 cm of soda melt remaining on its bottom, which is then cooled off and removed by conventional methods, by dissolving and cutting using a pressurised water jet.

In the foregoing, the invention has been described by way of example by the aid of the attached drawings, but different embodiments of the invention are possible within the scope of the inventive idea defined by the claims.

What is claimed is:

1. Method for removing soda melt from a soda recovery boiler in conjunction with a shut-down of the soda recovery boiler, which comprises:

interrupting a supply of lye into the boiler;

burning a pile of congealed soda accumulated in the boiler using a flame of a gas or oil burner until the soda melt surface in the soda recovery boiler has fallen to a level of a lower edge of a discharge opening;

continuing the heating of the soda melt with the gas or oil burner flame in order to keep the soda melt in the molten state; and pumping the soda melt out from the soda recovery boiler.

2. The method according to claim 1, wherein the soda melt is pumped out through the discharge opening of a soda melt channel.

3. The method according to claim 1, wherein the pumping is effected using a spiral pump provided with a suction pipe and a spiral.

4. The method according to claim 3, wherein the suction pipe of the spiral pump is inserted in the soda recovery boiler via the discharge opening of a soda melt channel.

5. The method according to claim 3, wherein the spiral pump is preheated before being inserted into the soda melt.

6. The method according to claim 5, further comprising rotating the spiral inside the suction pipe in a direction opposite to the pumping direction, while the spiral pump is being preheated and inserted into the soda melt.

7. The method according to claim 1, wherein the soda melt is pumped into a soda melt channel.

8. The method according to claim 7, further comprising breaking the pumped soda melt into droplets with steam.

9. Device for removing soda melt from a soda recovery boiler, said soda recovery boiler comprising a soda melt channel mounted outside the soda recovery boiler and a discharge opening in the soda recovery boiler for discharging soda melt from the soda recovery boiler into the soda melt channel, said device comprising a suction pipe designed to be inserted through the discharge opening, a spiral operatively associated to power means and rotatable inside the suction pipe, and a soda melt outlet duct leading out from the suction pipe and opening outside the soda recovery boiler into the soda melt channel.

10. Device for removing soda melt from a soda recovery boiler, said soda recovery boiler comprising a soda melt channel mounted outside the soda recovery boiler and a discharge opening in the soda recovery boiler for discharging soda melt from the soda recovery boiler into the soda melt channel, said device comprising a suction pipe designed to be inserted through the discharge opening, a spiral operatively associated to power means and rotatable inside the suction pipe, and a soda melt outlet duct leading out from the suction pipe and opening outside the soda recovery boiler, said outlet duct comprising a pipe branching out with a downward curvature from the suction pipe toward the soda melt channel.

* * * * *